US008431873B2

(12) United States Patent
Wang et al.

(10) Patent No.: US 8,431,873 B2
(45) Date of Patent: Apr. 30, 2013

(54) VANE TYPE ELECTRIC HEATER AND VANE STRUCTURE THEREOF

(75) Inventors: Cheng-Tu Wang, Taipei (TW); Meng-Cheng Huang, Taipei (TW)

(73) Assignee: Chaun-Choung Technology Corp., New Taipei (TW)

( * ) Notice: Subject to any disclaimer, the term of this patent is extended or adjusted under 35 U.S.C. 154(b) by 1248 days.

(21) Appl. No.: 12/239,883

(22) Filed: Sep. 29, 2008

(65) Prior Publication Data

US 2010/0078425 A1 Apr. 1, 2010

(51) Int. Cl.
*H05B 3/02* (2006.01)
*H05B 3/40* (2006.01)

(52) U.S. Cl.
USPC ..... 219/538; 219/530; 219/504; 219/505; 219/534; 219/535; 219/536; 219/539; 219/520; 219/540; 219/541

(58) Field of Classification Search ..... 219/530, 219/504–5, 534–6, 538–9, 520, 540–1
See application file for complete search history.

(56) References Cited

U.S. PATENT DOCUMENTS 5,995,711 A * 11/1999 Fukuoka et al. ..... 392/347

* cited by examiner

*Primary Examiner* — Shawntina Fuqua
(74) *Attorney, Agent, or Firm* — Chun-Ming Shih; HDLS IPR Sercies

(57) ABSTRACT

A vane type electric heater includes a heat generator and a vane structure, and the heat generator includes a rod, and the vane structure includes a plate and at least one heat pipe attached on a surface of the plate, and the plate includes a through hole for passing the rod, and the heat pipe surrounds the periphery of the through hole for enhancing the speed of thermal conduction and the effect of uniform temperature, so as to improve the heat output performance of the invention.

20 Claims, 10 Drawing Sheets

VANE TYPE ELECTRIC HEATER AND VANE STRUCTURE THEREOF

BACKGROUND OF THE INVENTION

1. Field of the Invention

The present invention generally relates to an electric heater, and more particularly to a vane type electric heater and a vane structure of the heater.

2. Description of Prior Art

As science and technology advance, electric heaters are introduced to bring us convenience and benefits and become a necessary household electric appliance. Various types of electric heaters are available in the market, and most of them have the drawbacks of large volume, heavy weight, low safety, oxygen combustion, and slow heating speed.

In general, a conventional oil impregnated vane type electric heater includes a frame, a plurality of vanes, an electrothermal pipe and a fan. The vanes are contained in the frame, and hot oil is filled into the vanes, and the electrothermal pipe is mounted onto the frame, and passed and connected to the vanes, and the fan is installed correspondingly with the vanes to constitute the oil impregnated vane type electric heater.

When the oil impregnated vane type electric heater is used, the oil impregnated electric heater is turned on to start its operation, and the electrothermal pipe will generate heat to heat up a hot oil which is circulated to conduct the heat to the vanes, and then the fan is turned on to start its operation to blow the heat produced by the vanes through a compulsory convection way, so as to achieve the warming effect.

However, the aforementioned oil impregnated vane type electric heater has the disadvantages of high price, heavy weight, pollution and low safety. Furthermore, a peculiar smell is produced during the heating process, and the speed of heating the hot oil is relatively slow and the slow speed will reduce speed of conducting heat to the vanes and lower the overall heat output efficiency.

Another conventional vane type electric heater includes a frame, a plurality of vanes, an electrothermal plate and a plurality of heat pipes. The vanes are contained in the frame, and the electrothermal plate is mounted onto the frame and disposed under the vanes, and an end of each heat pipe is passed into each vane, and another end of each heat pipe is passed into the electrothermal plate. With the heat pipes passed into the vanes respectively, the speed of conducting heat to the vanes can be improved, and the price of such electric heater has the advantages of low price, light weight, free of pollution, high safety and free of peculiar smell.

However, the practical use of the aforementioned vane type electric heater still has the following drawbacks. Since the heat pipe is passed into the vane, the contact area of the heat pipe and the vane is limited to the area at the periphery of the heat pipe and cannot further improve the speed of conducting heat to the vanes effectively (In other words, the heating speed is slow), and the heat output performance of the vane type electric heater is affected adversely. In the meantime, the heat produced by the electrothermal plate is conducted from the heat pipes to the vanes, and thus the electrothermal plate is not in a direct contact with the vanes, and the heat output performance of the vane type electric heater cannot be improved effectively.

In view of the shortcomings of the prior art, the inventor of the present invention based on years of experience to conduct extensive researches and experiments, and finally developed an electric heater to overcome the shortcomings of the prior art.

SUMMARY OF THE INVENTION

It is a primary objective of the present invention to provide a vane type electric heater and its vane structure, wherein a heat pipe is attached on a surface of a plate to increase the speed of conducting heat to the plate, so as to improve the heat output performance.

Another objective of the present invention is to provide a vane type electric heater and its vane structure, wherein the design of combining the heat pipe and the plate has the advantages of low price, light weight, free of pollution, high safety and free of peculiar smell.

To achieve the foregoing objective, the present invention provides a vane type electric heater comprising a heat generator and a vane structure, and the heat generator includes a rod, and the vane structure includes a plate and at least one heat pipe attached on a surface of the plate, and the plate has a through hole disposed thereon for passing the rod, and the heat pipe surrounds the periphery of the through hole and extends to the whole plate.

The present invention further provides a vane structure of a vane type electric heater comprising a plate and at least one heat pipe, and the plate includes a through hole, and the heat pipe is attached on a surface of the plate, and the heat pipe has an arc-shaped heat absorption section and a heat release section extended from the heat absorption section, and the internal periphery of the heat absorption section surrounds the periphery of the through hole.

A further objective of the present invention provides a vane type electric heater and its vane structure, wherein the heat absorption section of the heat pipe surrounds the periphery of the through hole and contacts a rod for enhancing the conducting heat speed and the uniform temperature effect.

To make it easier for our examiner to understand the present invention, we use preferred embodiments with related drawings for the detailed description of the present invention as follows:

DETAILED DESCRIPTION OF THE INVENTION

The technical characteristics, features and advantages of the present invention will become apparent in the following detailed description of preferred embodiments with reference to the accompanying drawings, and the preferred embodiments are used for illustrating the present invention only, but not intended to limit the scope of the invention.

Figure 1:
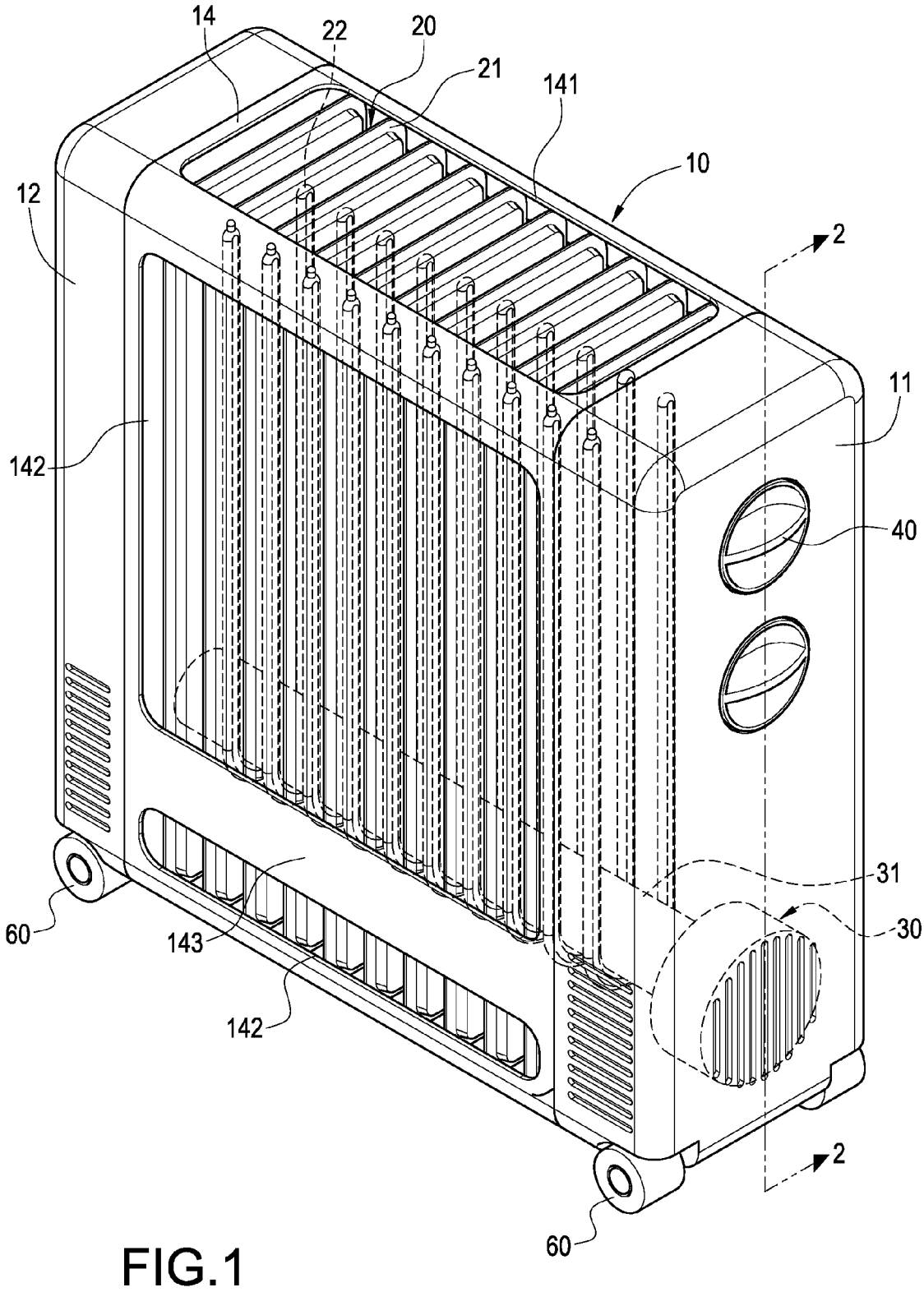
FIG. 1 is a perspective view of the present invention.
Figure 2:
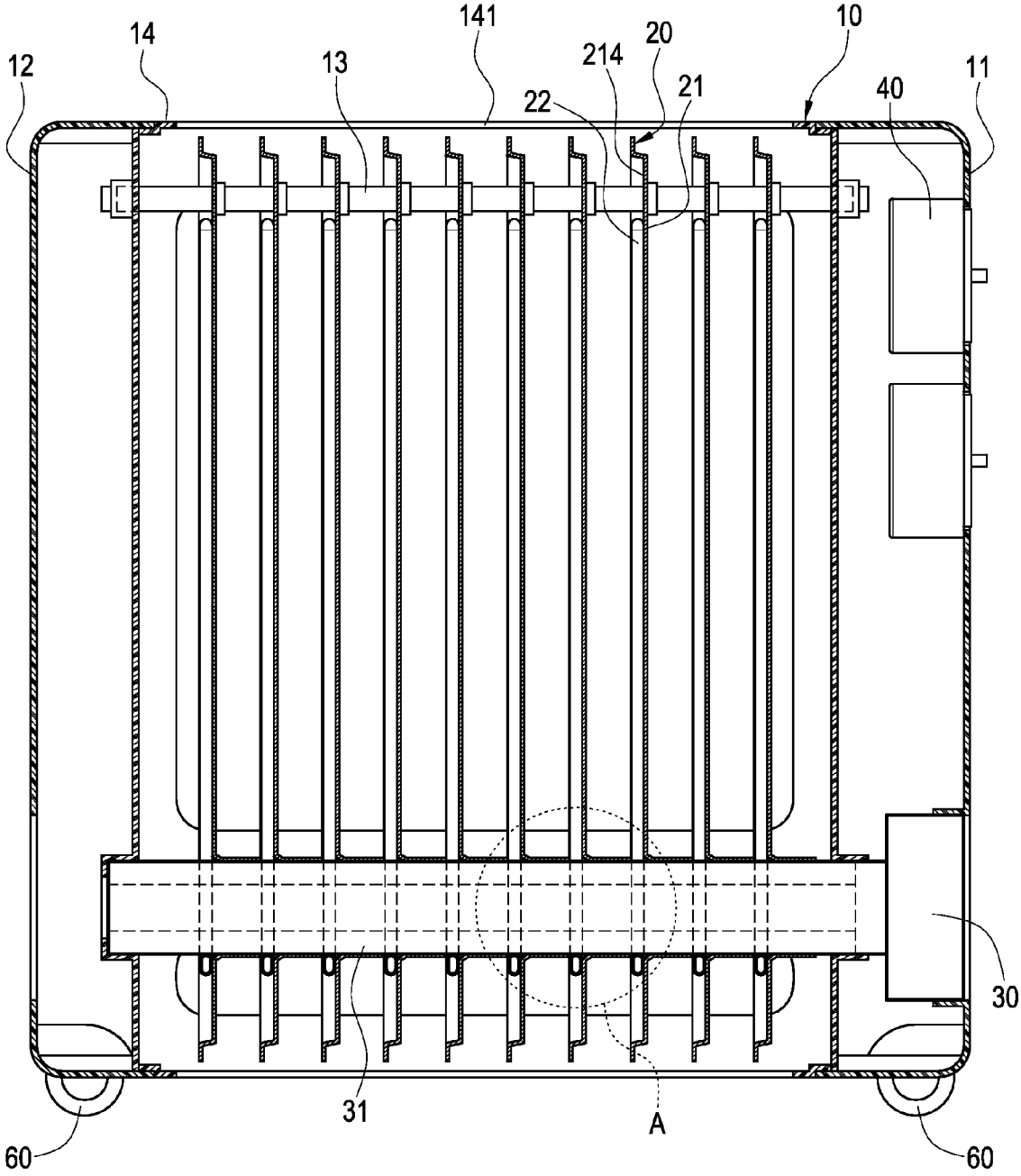
FIG. 2 is a cross-sectional view of Section 2-2 as depicted in FIG. 1.
Figure 3:
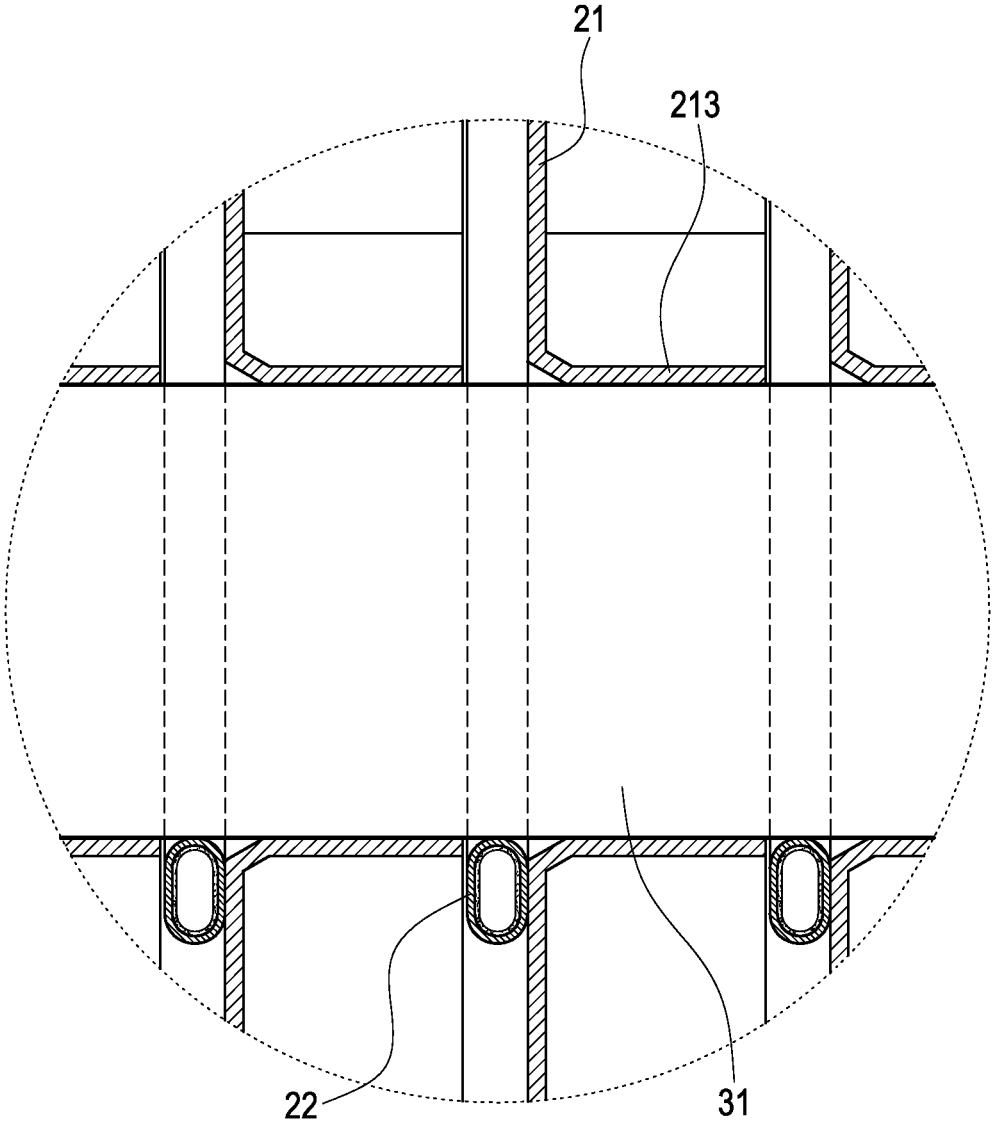
FIG. 3 is a partial enlarged view of Section A of FIG. 2.

With reference to FIGS. 1 to 3, a vane type electric heater of the invention comprises a frame 10, a vane structure 20 and a heat generator 30.

The frame 10 comprises a front panel 11, a rear panel 12, a plurality of support rods 13 with both ends coupled between the front and rear panels 11, 12, and a rectangular frame 14 coupled between the front panel 11 and the rear panel 12, wherein a hollow portion 141 is disposed on the top surface of the rectangular frame 14, and a plurality of penetrating portions 142 are disposed on a lateral side of the rectangular frame 14, and a protecting bar 143 is formed between the penetrating portions 142, and the frame 10 is made of a high temperature resistant plastic material.

Figure 4:
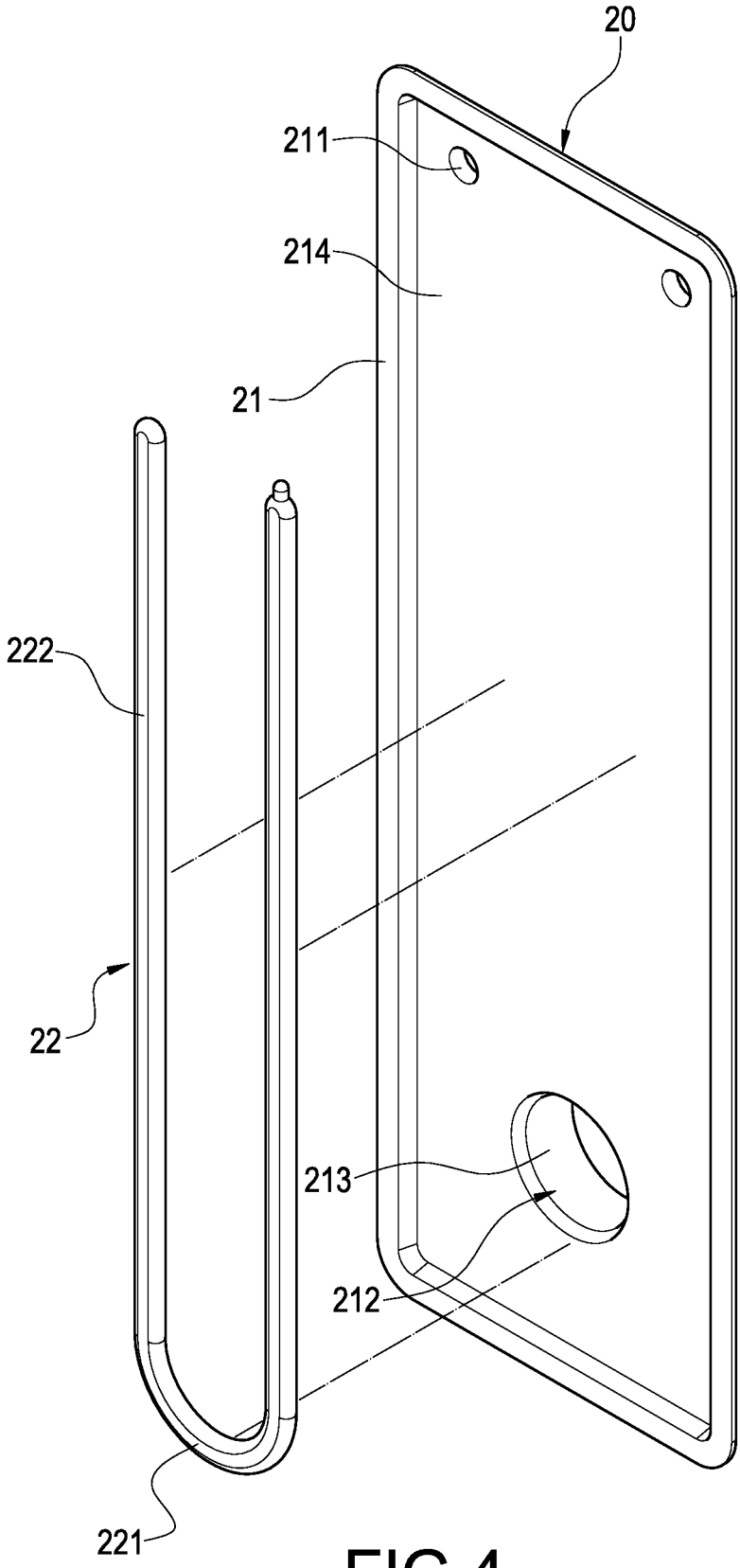
FIG. 4 is a perspective view of a vane structure of the present invention.

The vane structure 20 is installed in the frame 10 and comprises a plate 21 and at least one heat pipe 22 attached on a surface of the plate 21. A recess area 214 is formed on the plate 21, and a plurality of openings 211 and a through hole 212 (as shown in FIG. 4) are formed on the plate 21 and disposed in the recess area 214, and the openings 211 are provided for passing the corresponding support rods 13 respectively, and a circular wall 213 is protruded from the plate 21 and surrounds the periphery of the through hole 212, and the circular wall 213 maintains a specific distance between the plate 21 and another plate 21 for circulating air in a natural convection, after the plate 21 is coupled to the support rods 13, and the through hole 212 is a circular hole, and the opening 211 is a circular hole or a rectangular slot, and the heat pipe 22 is a U-shaped heat pipe situated in the recess area 214, and the heat pipe 22 includes a heat absorption section 221 and an arc-shaped heat release section 222 extended from the heat absorption section 221, and the internal periphery of the heat absorption section 221 surrounds the periphery of the through hole 212.

Figure 5:
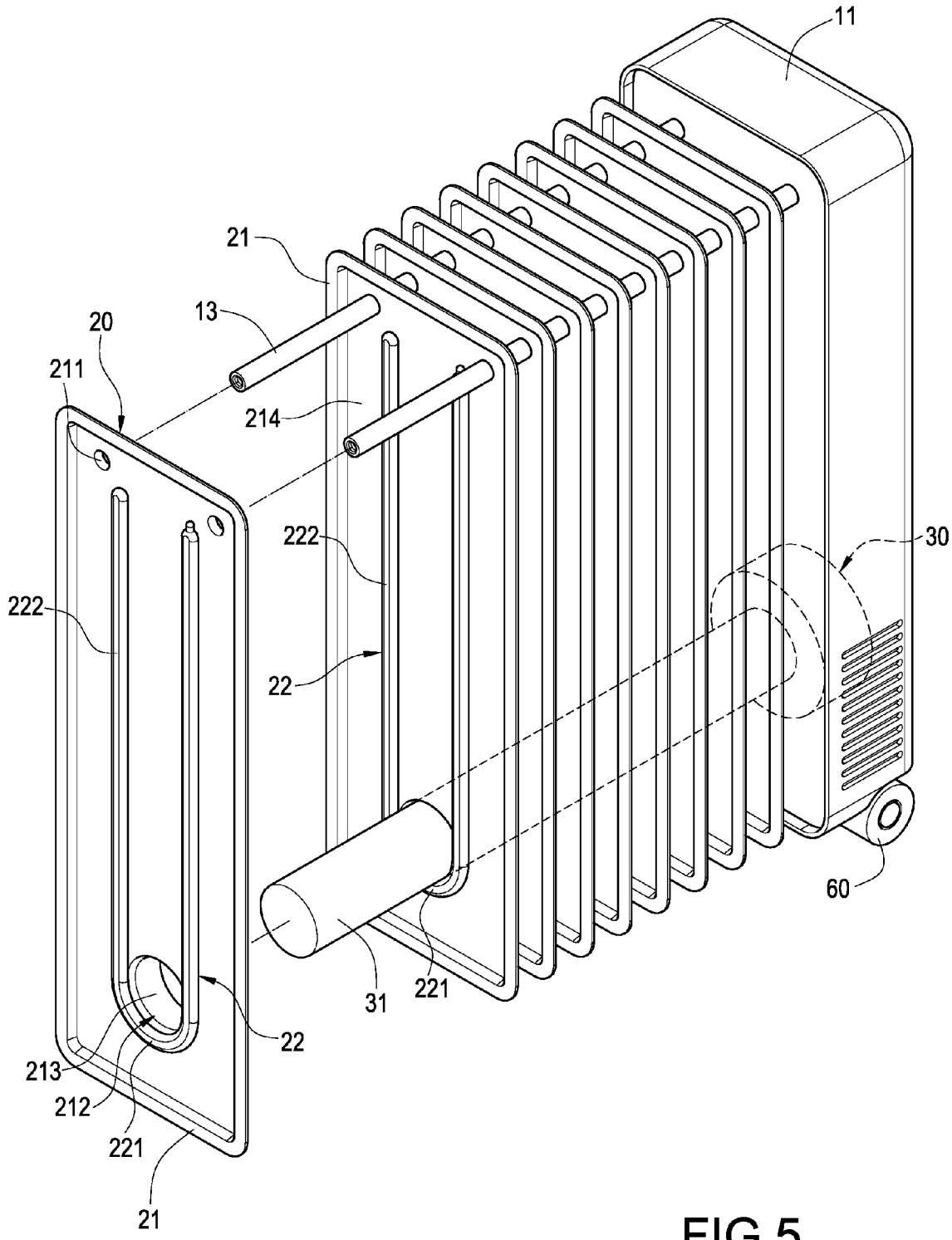
FIG. 5 is an exploded view of an assembling operation of the present invention.

The heat generator 30 includes a rod 31 fixed onto the frame 10, passed through the through hole 212 of the plate 21 (as shown in FIG. 5), and sheathed by the circular wall 213, wherein both ends of the rod 31 are coupled between the front panel 11 and the rear panel 12 and blocked by the protecting bar 143, and the protecting bar 143 is provided for protecting a user's hand from touching the rod 31 to avoid possible burning, and the rod 31 is an electrothermal pipe.

The present preferred embodiment further comprises a temperature sensor (not shown in the figure) installed on the plate 21, and a temperature adjusting button 40 disposed on the front panel 11 and electrically coupled to a temperature indicator (not shown in the figure) of the temperature sensor, and the temperature adjusting button 40 is provided for adjusting the temperature of the rod 31 of the heat generator 30, and the temperature sensor is provided for detecting the temperature of the plate 21 and displayed the detected temperature through the temperature indicator.

This preferred embodiment further comprises a plurality of rollers 60 coupled to both sides at the bottom of the front panel 11 and the rear panel 12 respectively for facilitating users to tow or move the electric heater of the invention.

Figure 6:
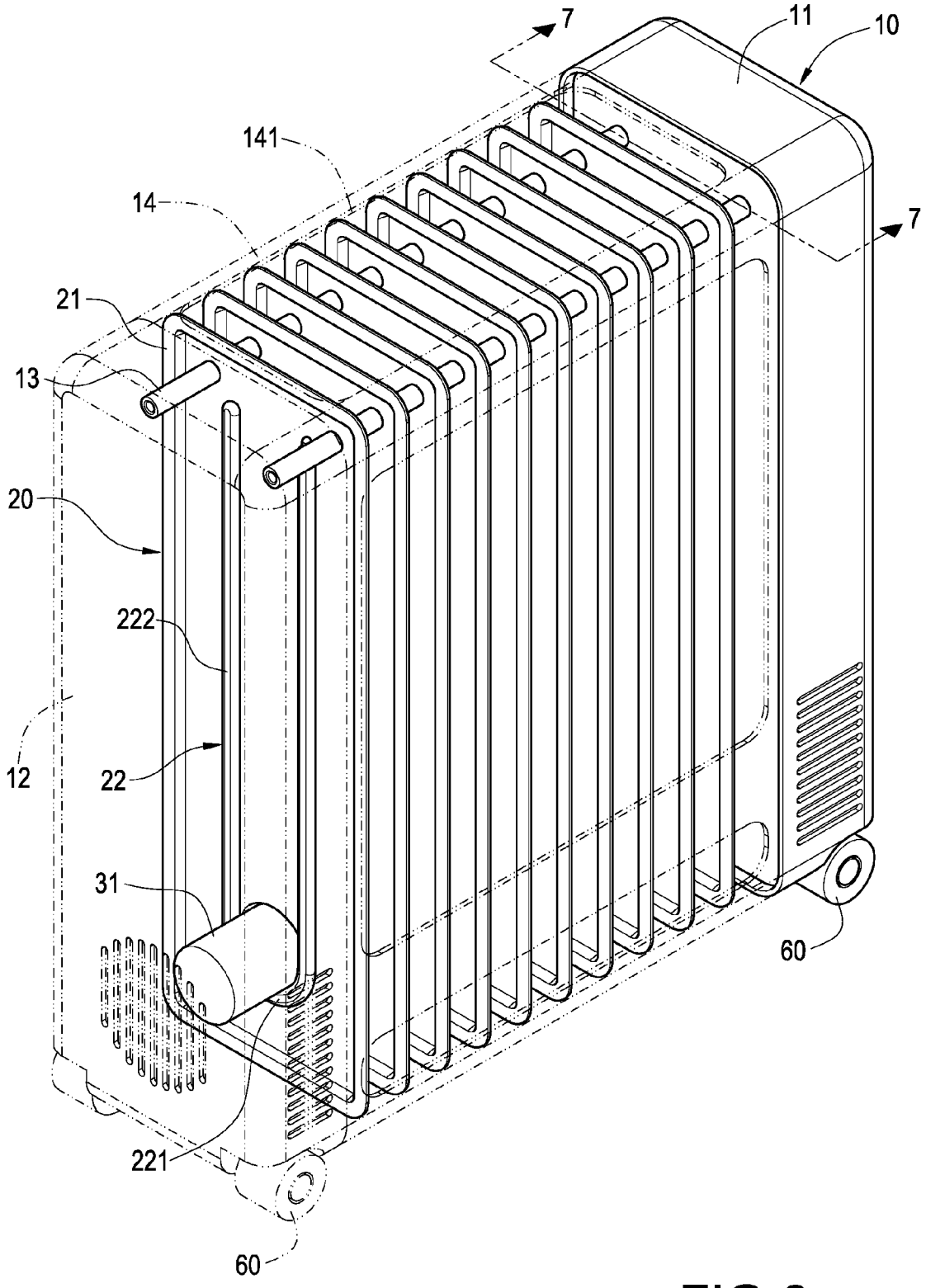
FIG. 6 is a schematic view of completing the assembling operation as depicted in FIG. 5.
Figure 7:
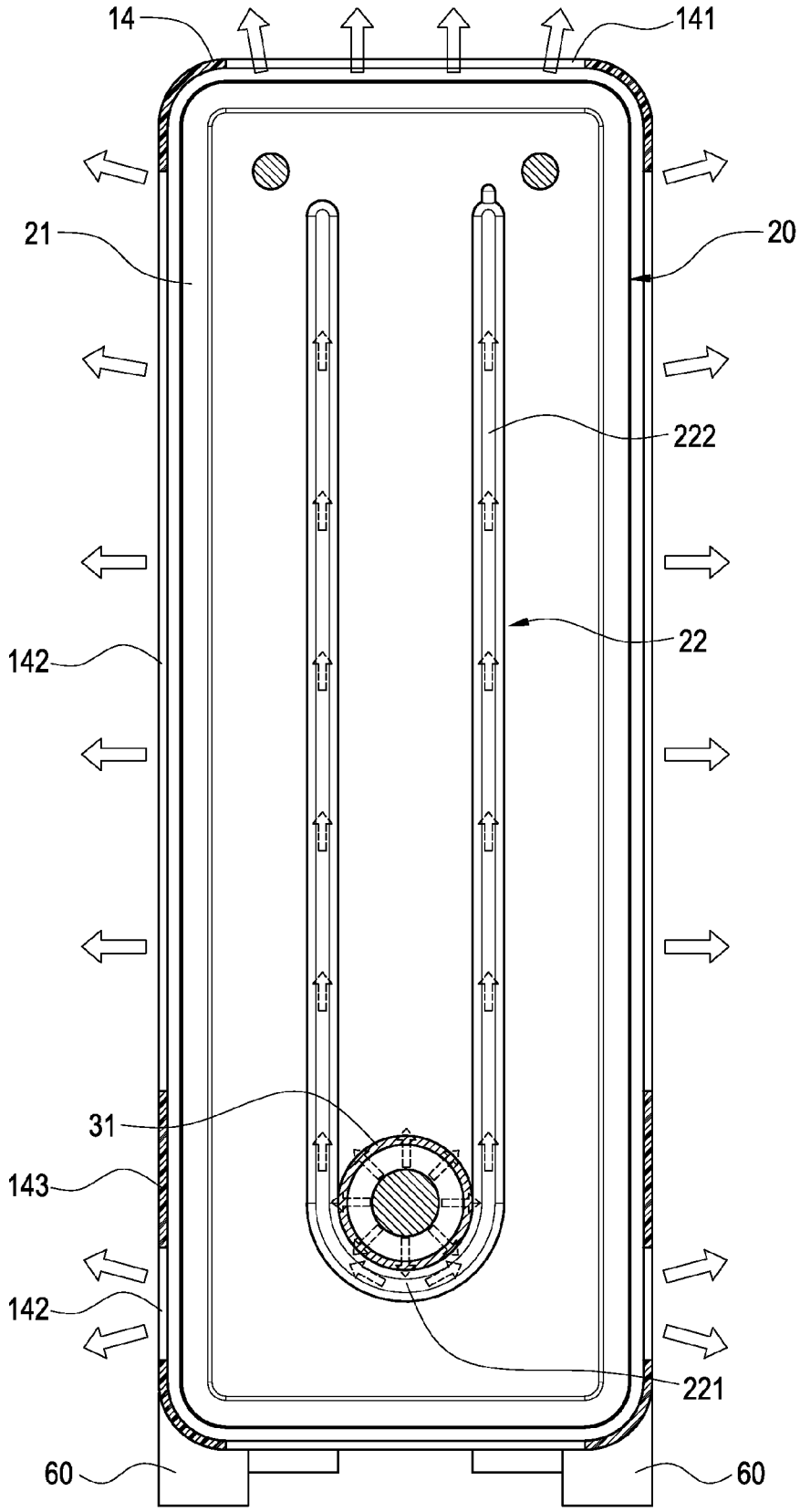
FIG. 7 is a cross-sectional view of Section 7-2 as depicted in FIG. 6.

When the heater of the invention is used as shown in FIGS. 6 and 7, the vane type electric heater is turned on first, and then the rod 31 of the heat generator 30 will produce heat and conducts the heat to the plate 21 and the heat pipe 22, and the heat absorption section 221 of the heat pipe 22 absorbs the heat from the rod 31 and conducts the heat to the heat release section 222, and dissipates the heat produced by the heat release section 222 and the rod 31 from the plate 21. The natural convection of air sends out the heated air to achieve a quick warming effect.

During the aforementioned using process, the rod 31 is passed into the plate 21, and the heat pipe 22 is attached flatly on a surface of the plate 21 and contacted with the rod 31 for increasing the contact area between the plate 21 and the heat generator 30, such that the heat produced by the rod 31 can be conducted directly to the plate 21 for a heat dissipation and also can be conducted quickly from the heat pipe 22 to the plate 21 for the heat dissipation, so as to enhance the heat conducting speed, achieve the uniform temperature effect, and improve the heat output performance.

Compared with the conventional vane type electric heater using hot oil for heating, the aforementioned design of combining the heat pipe 22 and the plate 21 in accordance with the present invention has the advantages of low price, light weight, free of pollution, high safety and free of peculiar smell.

It is noteworthy to point out that the heat pipe 22 is attached flatly on a surface of the plate 21 or embedded into the plate 21 to achieve the same effect of increasing the heat conduction area between the heat pipe 22 and the plate 21, so as to increase the heat conducting speed, and the heat pipe 22 is attached onto a surface of the plate 21 by a soldering method, and the heat pipe 22 is embedded and fixed into the plate 21 by a gluing method.

Figure 8:
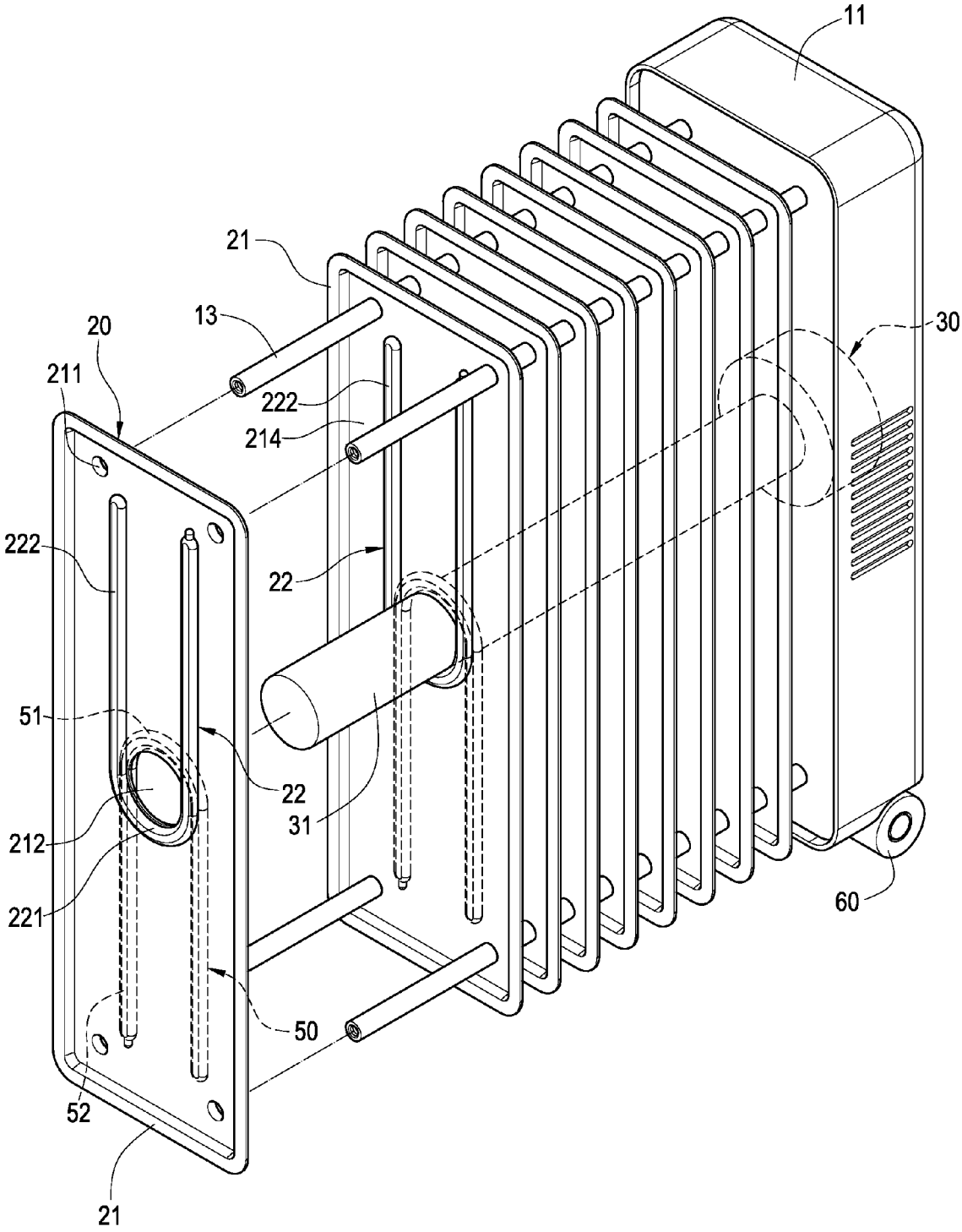
FIG. 8 is a schematic view of another preferred embodiment of the present invention.

With reference to FIG. 8 for a schematic view of another preferred embodiment of the present invention, the difference of this embodiment from the foregoing embodiments resides on that this embodiment further comprises a heat pipe 50 attached onto another surface of the plate 21, and another heat pipe 50 can be a U-shaped heat pipe contacted with the rod 31, wherein the other heat pipe 50 includes an arc-shaped heat absorption section 51 and a heat release section 52 extended from the heat absorption section 51, and the internal periphery of the heat absorption section 51 surrounds and contacts with the surface of the periphery of the rod 31 and aligned evenly with the through hole 212 for further increasing the heat conducting speed and enhancing the heat output performance. This embodiment can further shorten the lengths of the heat pipe 22 and the other a heat pipe 50 and the height of the plate 21 to reduce the volume along the longitudinal direction.

Figure 9:
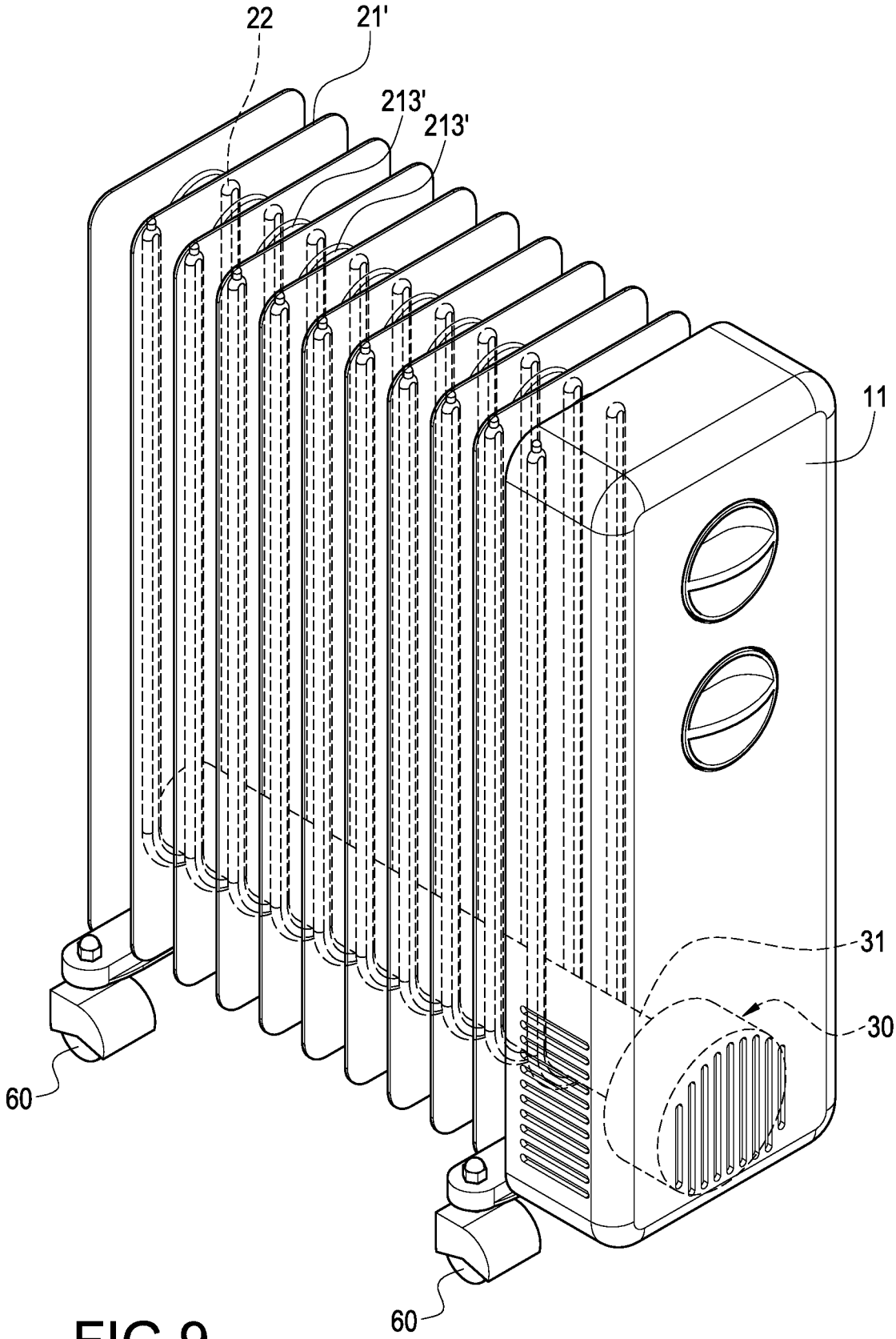
FIG. 9 is a schematic view of a further preferred embodiment of the present invention.

With reference to FIG. 9 for another preferred embodiment of the present invention, the difference of this embodiment from the foregoing embodiments resides on that this embodiment does not requires installing the rectangular frame 14, the rear panel 12 and the support rod 13, and a surface of the plate 21' is a plane, and the heat pipe 22 is attached flatly onto the plane, and a circular wall 213' is protruded from the plane, and the circular wall 213' is passed through and fixed to the circular wall 213' of another plate 21'.

Figure 10:
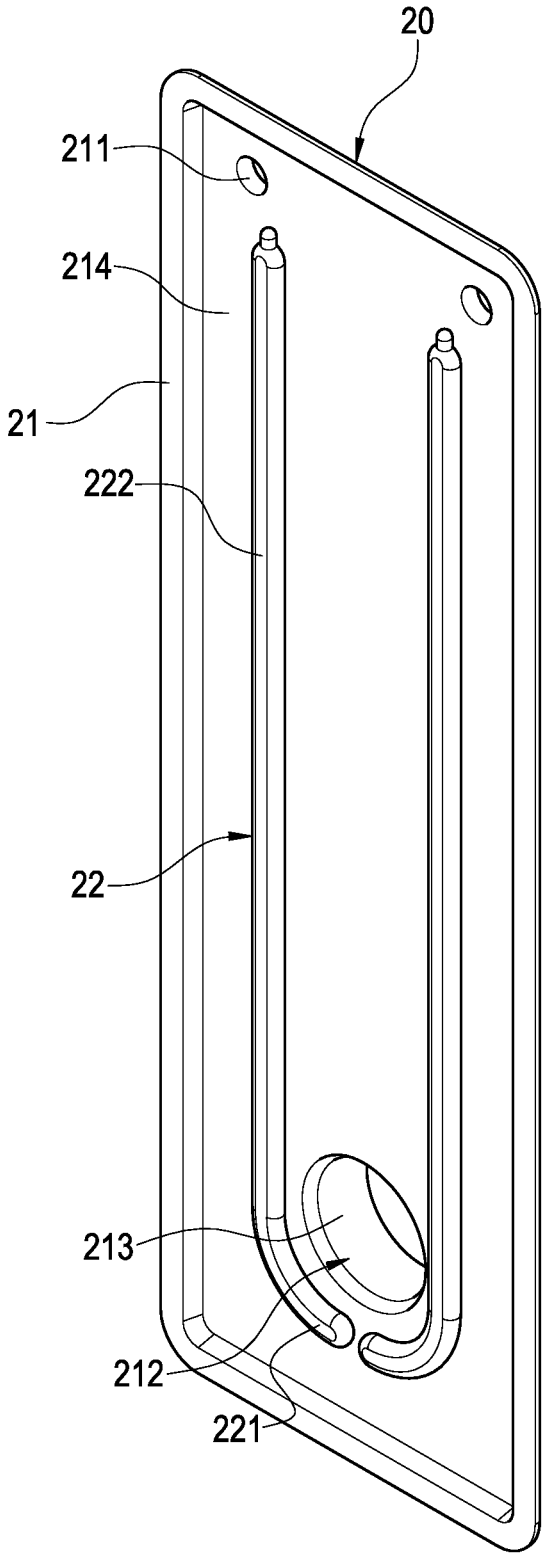
FIG. 10 is a schematic view of another further preferred embodiment of the present invention.

With reference to FIG. 10 for a further preferred embodiment of the present invention, the difference of this embodiment from the foregoing embodiments resides on that the heat pipe 22 of this embodiment is substantially L-shaped or J-shaped to achieve the same effect of the foregoing embodiments.

In summation of the description above, the present invention enhances the safety, the heat conducting speed and the heat output performance and achieves the effects of providing a fast warming and overcoming the shortcomings of the prior art. Obviously, the invention complies with the patent application requirements, and thus is duly file for patent application.

What is claimed is:

1. A vane structure of a vane type electric heater, comprising:

a plate, having a through hole thereon; and at least one heat pipe, attached on a surface of the plate, and each heat pipe having a heat absorption section and a heat release section extended from the heat absorption section, and the internal periphery of the heat absorption section being surrounded around the periphery of the through hole.

2. The vane structure of a vane type electric heater as recited in claim 1, wherein the plate forms a recess area thereon, and the heat pipe is disposed in the recess area.

3. The vane structure of a vane type electric heater as recited in claim 1, further comprising a circular wall protruded from the plate and disposed around the periphery of the through hole.

4. The vane structure of a vane type electric heater as recited in claim 1, wherein the heat pipe is substantially U-shaped, L-shaped or J-shaped.

5. The vane structure of a vane type electric heater as recited in claim 1, wherein the heat absorption section is substantially arc-shaped.

6. The vane structure of a vane type electric heater as recited in claim 1, wherein a surface of the plate is a plane, and the heat pipe is attached flatly onto the plane.

7. The vane structure of a vane type electric heater as recited in claim 6, further comprising a circular wall protruded from the plane.

8. A vane type electric heater, comprising:

a heat generator, having a rod; and a vane structure, including a plate and at least one heat pipe attached on a surface of the plate, and the plate having a through hole disposed thereon for passing the rod, and the heat pipe surrounding the periphery of the through hole.

9. The vane type electric heater of claim 8, further comprising a front panel and a rear panel corresponding to the front panel, and both ends of the rod being coupled to the front panel and the rear panel respectively.

10. The vane type electric heater of claim 9, further comprising a temperature adjusting button disposed on the front panel for adjusting and controlling the temperature of the rod of the heat generator.

11. The vane type electric heater of claim 8, further comprising a plurality of support rods, and the plate having a plurality of openings for passing and connecting the support rods.

12. The vane type electric heater of claim 8, wherein the heat generator is an electrothermal pipe.

13. The vane type electric heater of claim 8, wherein the plate forms a recess area, and the heat pipe is disposed in the recess area.

14. The vane type electric heater of claim 8, wherein a surface of the plate is a plane, and the heat pipe is attached flatly onto the plane.

15. The vane type electric heater of claim 14, further comprising a circular wall protruded from the plane.

16. The vane type electric heater of claim 8, further comprising a circular wall protruded from the plate and surrounding the periphery of the through hole for coupling the external surface of the rod.

17. The vane type electric heater of claim 8, wherein the heat pipe is U-shaped, L-shaped or J-shaped.

18. The vane type electric heater of claim 8, wherein the heat pipe has a heat absorption section and a heat release section extended from the heat absorption section, and the internal periphery of the heat absorption section surrounds the external periphery of the rod.

19. The vane type electric heater of claim 18, wherein the heat absorption section is in contact with the rod.

20. The vane type electric heater of claim 18, wherein the heat absorption section is substantially arc-shaped.

* * * * *